United States Patent [19]

Davidson, deceased et al.

[11] Patent Number: 4,764,161

[45] Date of Patent: Aug. 16, 1988

[54] GREENHOUSE FILM FOLDING APPARATUS

[75] Inventors: James H. Davidson, deceased, late of Terre Haute, Ind., by Ruby E. Davidson, legal representative; John F. Pollock, Terre Haute, Ind.

[73] Assignee: Ethyl Corporation, Richmond, Va.

[21] Appl. No.: 557,532

[22] Filed: Dec. 2, 1983

[51] Int. Cl.[4] ..... B31B 1/36

[52] U.S. Cl. ..... 493/248; 493/439; 493/438

[58] Field of Search ..... 493/436, 438, 439, 440, 493/459, 444, 302, 248

[56] References Cited

U.S. PATENT DOCUMENTS

| | | | |
|---|---|---|---|
| 1,838,704 | 12/1931 | Potdevin | 493/248 |
| 2,125,306 | 8/1938 | Novick | 493/248 |
| 2,320,326 | 5/1943 | Avery | 493/248 |
| 2,428,837 | 10/1947 | Denton | 493/248 |
| 2,532,784 | 12/1950 | Reitzes | 493/248 |

*Primary Examiner*—D. B. Jones

*Attorney, Agent, or Firm*—John F. Sieberth

[57] ABSTRACT

An apparatus for folding large sheets of thermoplastic film in a U-shaped fold comprising a trapezoidal former or frame which tapers from a relatively wide width to a substantially narrower width about one-half the width of the relatively wide width and which extends downwardly across a flat plane about the width of the narrower width, a tucker bar or V-shaped member mounted on the trapezoidal former for receiving and inwardly folding the edges of the film to be folded, and a top plane mounted on the trapezoidal former just above and substantially parallel to the tucker bar for receiving and guiding the unfolded portion of the plastic film thereover. Means for receiving the sheet of plastic film and guiding the film over the trapezoidal former and a means for receiving the plastic film after it has been folded are also provided. Adjustment means are further provided for raising and lowering the tucker bar.

11 Claims, 6 Drawing Sheets

GREENHOUSE FILM FOLDING APPARATUS

BACKGROUND OF THE INVENTION

The present invention is in the field of plastic film and especially in the field of large sheets of thermoplastic film generally referred to as greenhouse film.

Greenhouse film is a type of thermoplastic film made for covering greenhouses or other similar type hot houses used in growing plants and the like. Such film is customarily manufactured in large sheets. The sheets generally range in widths from about 10 feet to about 50 feet with lengths running from about 50 feet to about 500 feet. The film is also produced in various gauges, but usually has a thickness of about four mils to about six mils. Larger or smaller sizes can be made, but such are generally not desirable for most commercial uses.

Greenhouse film is presently manufactured as an elongated relatively flat tube of a predetermined length, width and gauge. For some purposes, the film is slit longitudinally on one side so that the film may be opened into a single flat sheet of about double the width of the flat tube.

These large sheets of thermoplastic film must be folded and packaged for storing and shipping to an end user. In order to facilitate their installation on a greenhouse, they are folded in a particular manner.

One type of fold employed in packaging greenhouse film that has been well received in the marketplace is a "U" type fold which is packaged as a roll which permits an installer of the film to center the roll on the apex of a roof or roof frame of a greenhouse, unroll the film the length of the greenhouse and then unfold the film to its full width down each side of the greenhouse. Such type of film fold construction is described in U.S. application Ser. No. 423,955, filed on Sept. 27, 1982, and which is hereby incorporated herein.

The handling of large sheets of thermoplastic film and the folding thereof are difficult and present a number of problems. It is important that the film be folded symmetrically, without hard folds, and be wrinkle-free. Often, it is necessary that films of various widths be manufactured more or less continuously.

It is, therefore, a principal object of the present invention to provide an apparatus which makes a "U" shaped fold of large sheets of plastic film, such as greenhouse film.

It is an important object of the instant invention to provide a plastic film or sheet folding apparatus which folds wide sheets of the film without the film having hard folds or obtaining wrinkles.

Another object of the invention is to provide an apparatus which provides for the continual folding of wide sheets of thermoplastic film of various widths into a "U" shaped fold.

Still another object of the present invention is to provide an apparatus which continually folds wide sheets of thermoplastic film into a "U" shaped fold quickly, easily and symmetrically.

These and other objects of the invention will become more readily apparent from a reading of the specification and drawings hereinafter.

SUMMARY OF THE INVENTION

An apparatus for continually folding wide sheets of thermoplastic film comprising a trapezoidal former or frame which tapers from a relatively wide width to a substantially narrow width about one-half the width of the relatively wide width and which extends downwardly across a flat plane about the width of the narrower width, a tucker bar or V-shaped member mounted on the trapezoidal former or frame for receiving and inwardly folding the edges of the film to be folded, a top plane or table mounted on the trapezoidal former or frame just above and substantially parallel to the tucker bar or triangularly shaped member for receiving and guiding the portion of the unfolded film thereover, means for receiving the sheet of plastic film and guiding the film over the trapezoidal former or frame, and a means for receiving the film after it has been folded. Adjustment means are provided for raising and lowering the tucker bar or triangularly-shaped member. Adjustment means are also provided for widening or narrowing the top plane or table for handling different size widths of plastic film.

DESCRIPTION OF THE PREFERRED EMBODIMENTS

Figure 1:
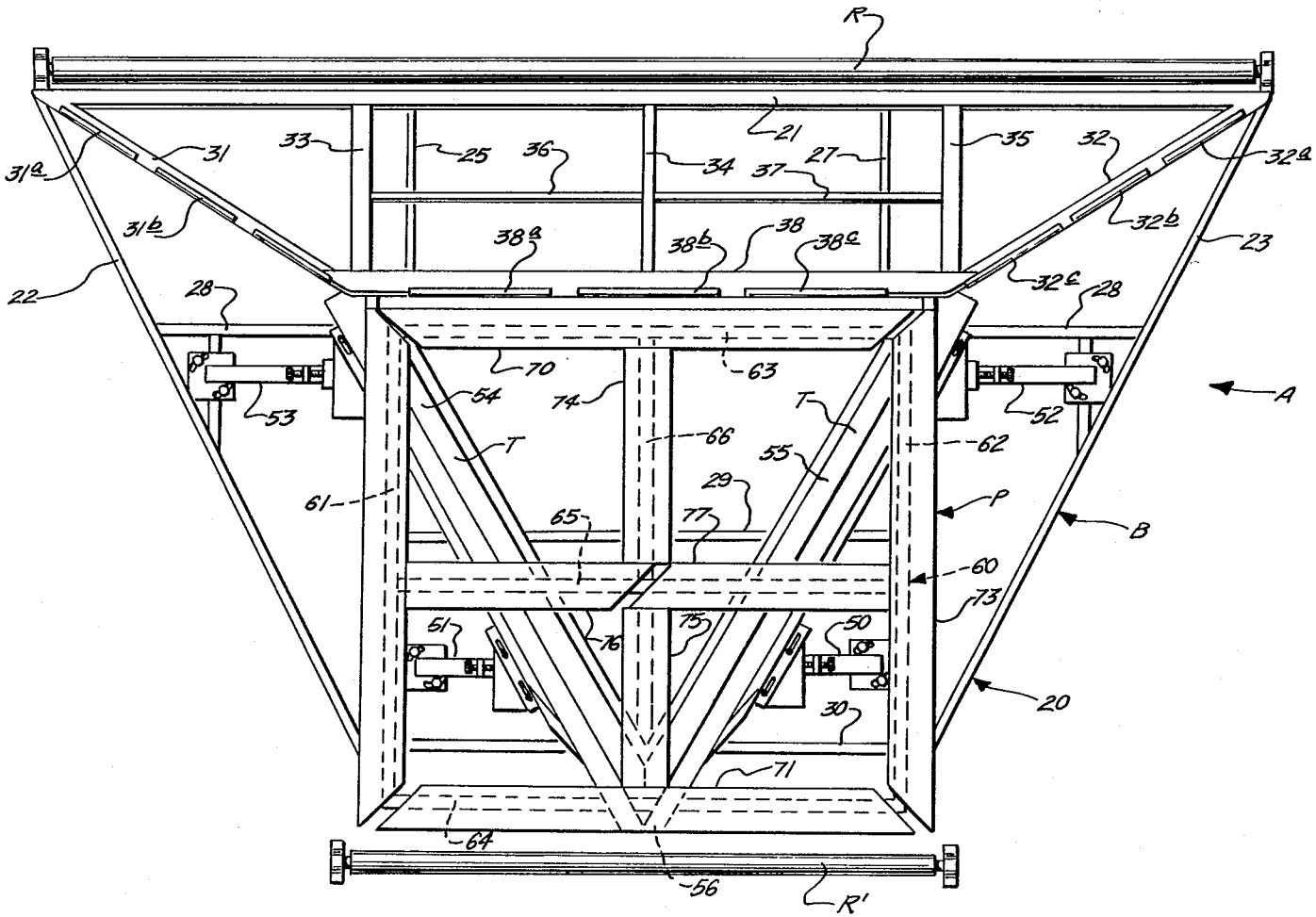
FIG. 1 is a top view of the plastic film folding apparatus of the invention.

Referring now to the drawings and especially to FIG. 1, the present invention is indicated generally at A. The apparatus A comprises a trapezoidal former or frame B, a tucker bar or triangular-shaped member T mounted thereon, a top plane or table P also mounted on the frame B and positioned just above the tucker bar T and substantially parallel thereto, a roll means or roller R for receiving a wide sheet of thermoplastic film and a second roll means or roller R′ for receiving the film after it has been folded.

The frame B includes support or floor frame 20 comprising rear base member 21, subframe or side base members 22 and 23 and front base member 24 (not seen). The members 22 and 23 are welded or otherwise attached to the rear base member 21 and extend inwardly and outwardly therefrom. The front base member 24 is parallel to the base member 21 and joins the members 22 and 23 together at their outer ends. Intermediate cross members 25, 26 (not seen) and 27 extend perpendicularly from the rear base member 21 to front base member 24. A reinforcing cross base member 28 parallel to member 21 extends between the members 22 and 23 and joins members 25, 26, and 27. A reinforcing cross member 29 extends perpendicularly between the members 25 and 27 and is parallel to the member 28. The member 29 is also parallel to the members 21 and 24. Another reinforcing cross member 30 extends perpendicularly between the members 25 and 27 and is also parallel to the members 21 and 24. Reinforcing members 28, 29 and 30 actually each comprise two or more separate members, but for simplicity of illustration are assigned only one number each. Member 28 is four members and members 29 and 30 are each two members. Additional or fewer reinforcing members may be used as required or desired. Base members 21–30 in effect form the floor support or frame 20 of the apparatus A. The various base members are steel beams attached to each other by welding or other suitable attachment means. It can be appreciated that the floor frame 20, although preferably in the trapezoidal form illustrated, can be of any convenient shape or made from other suitable construction materials. The frame 20 provides the base support for the trapezoidal former B and various parts of the apparatus A as will be explained hereinafter.

Figure 2:
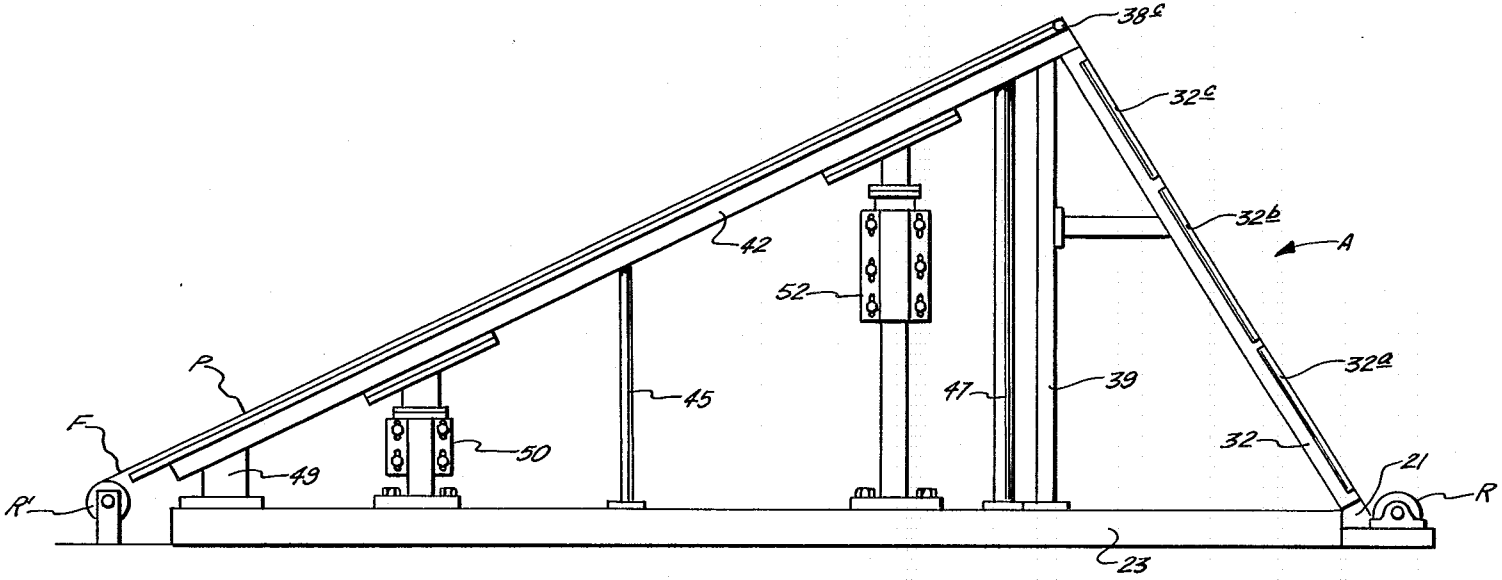
FIG. 2.is a side elevation of the apparatus of FIG. 1.
Figure 3:
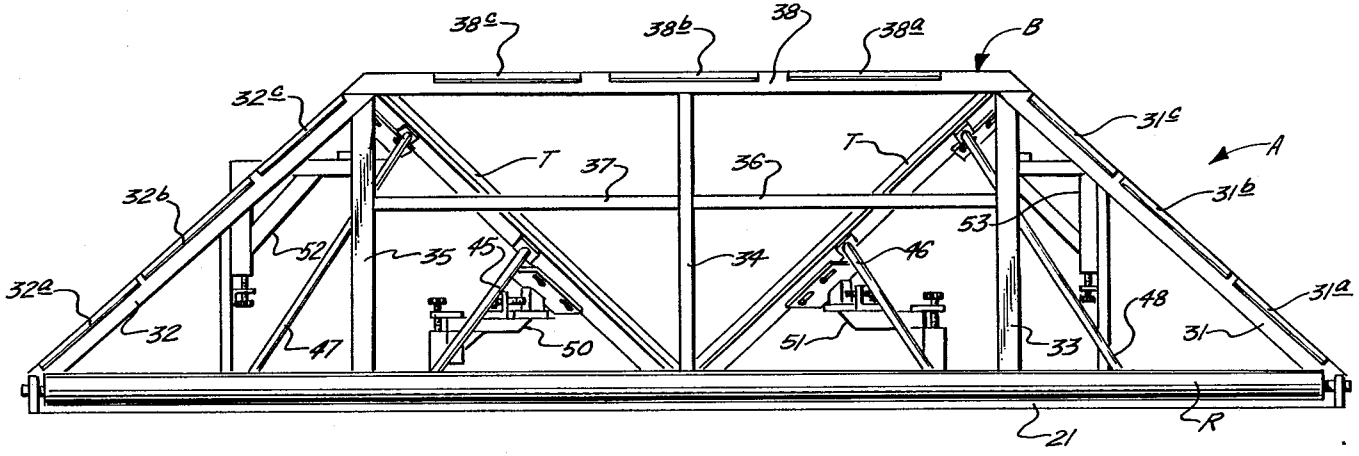
FIG. 3 is a rear elevation of the apparatus of FIG. 1.
Figure 7:
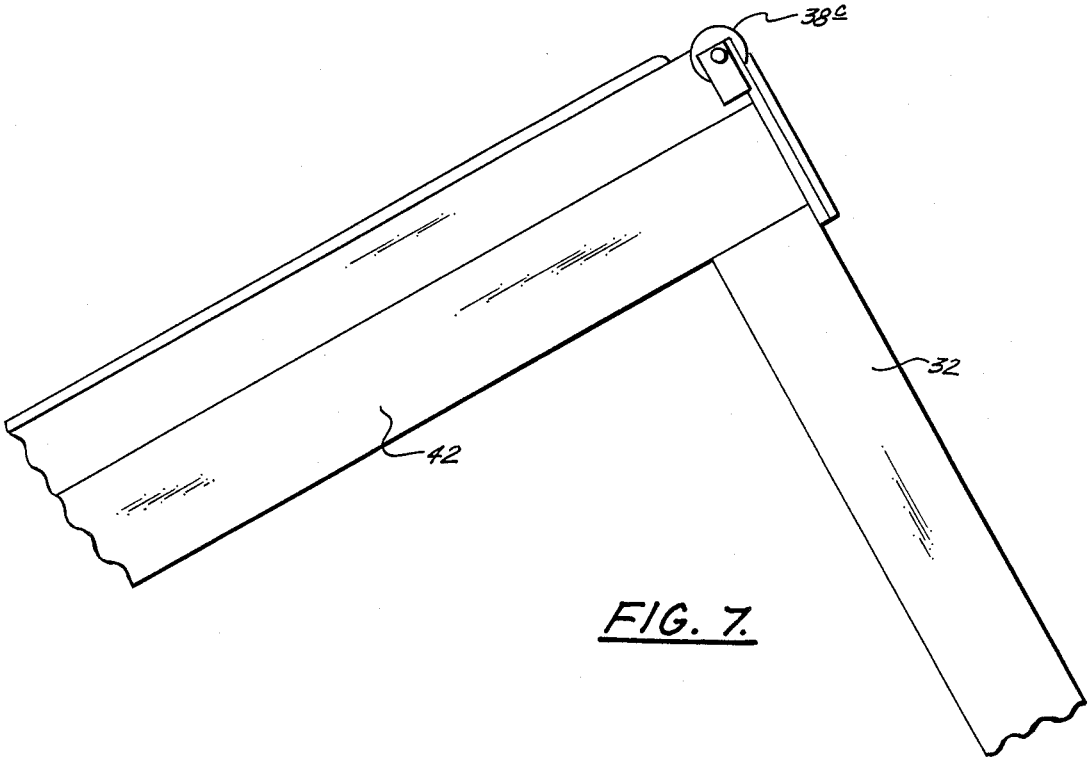
FIG. 7 is an enlarged detailed view of a top corner portion of the apparatus of FIG. 2, illustrating a roller.
Figure 8:
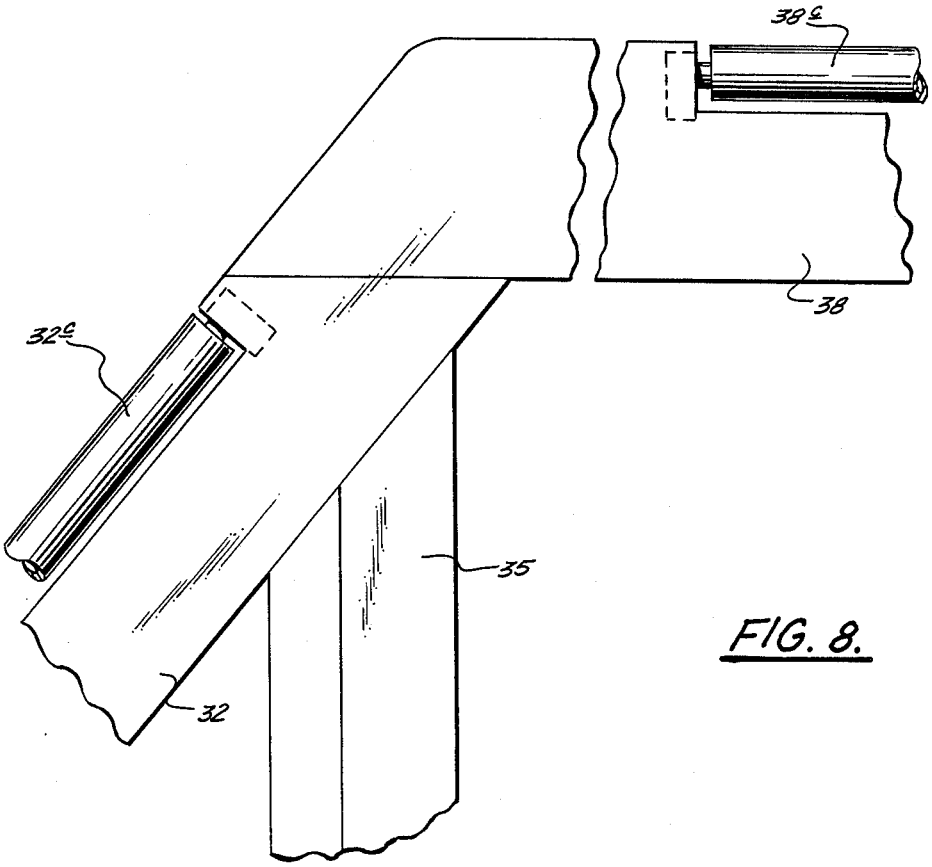
FIG. 8 is an enlarged view of the top left corner portion of the apparatus of FIG. 3 illustrating the rollers.

Viewing the apparatus A from the rear, as best seen in FIG. 3, extending upwardly and inwardly from base member 21 are rear frame members 31 and 32 and intermediate frame members 33, 34 and 35. Members 33 and 34 are reinforced by bracing member 36 and members 34 and 35 are joined together and reinforced by bracing member 37. Members 31 and 32 are joined together by rear frame top member 38. Members 31–34 are joined together across the top thereof by horizontal or rear top frame member 38. The member 38, as best seen in FIG. 2, is also supported by vertical support or frame members 39, 40 (not seen) and 41 (not seen) extend upwardly from the base frame member 28 to the top frame member 38. The members 39, 40 and 41 are parallel to each other. Extending angularly and downwardly from member 38 so as to meet together at their lower ends are frame members 42, 43 (not seen) and 44 (not seen). The members 42, 43 and 44 are supported by angular braces 45, 46, 47 and 48 and by short stanchion or front support member 49. Additional or fewer bracing members or support members can be used as desired or required. The rear frame members and top frame members of the trapezoid former are also steel beams or other suitable construction members. They are joined together by welding or other suitable attachment means.

A V-shaped member or tucker bar T is positioned on a pair of lower adjusting means 50 and 51 and a pair of upper adjusting means 52 and 53. The tucker bar T comprises basically two relatively wide members 54 and 55 which are joined together at one end thereof so as to form a "V" and will be explained in more detail hereinafter. The lower or front end of the tucker bar extends to a somewhat flattened end 56 just below the plane P.

The plane P is supported by a somewhat rectangularly shaped frame 60 which comprises outer frame members 61, 62, 63 and 64 and interior or cross support members 65 and 66. The members 61–66 are joined to each other by welding or other suitable means. Frame members 61–66 are also preferably of steel, but can be constructed of any other suitable materials. The cross frame member 66 is attached to the central angular frame member 43 at each end thereof. The top of the plane P comprises a series of flat members 70, 71, 72 and 73 which form a somewhat rectangularly shaped frame and interior flat members 74, 75, 76 and 77. Each of the members 70, 71, 72 and 73 are mitered on each end thereof. Each of the flat members 70–77 are attached to their underlying frame support members 60–66, as will be explained in more detail hereinafter. The interior edges of the members 76 and 77 are also mitered. These edges are shown spaced apart in FIG. 1 and in FIG. 4. The top plane P is hingedly attached to the rear frame top member 38 by means of extension plates 78 and 79 which are bolted to the member 38. The top plane P is so attached to the frame 60 that the flat plane members 72 and 76 and 73 and 77 may be moved laterally to increase or decrease the overall size of the top plane to fit a particular width of film to be folded. The flat members 70–77 are so positioned on their respective frame support members 60–66 that the top of the flat members substantially provides a table top surface. It can be appreciated that the plane or table P can be constructed of one or more flat members as desired. It is only necessary that a substantially flat rectangular surface about the width of the film after folding be provided. The flat members may be constructed of wood, metal, plastic or other suitable materials. The top surface of the plane P should be substantially smooth as to provide a surface over which the film may freely travel.

Figure 4:
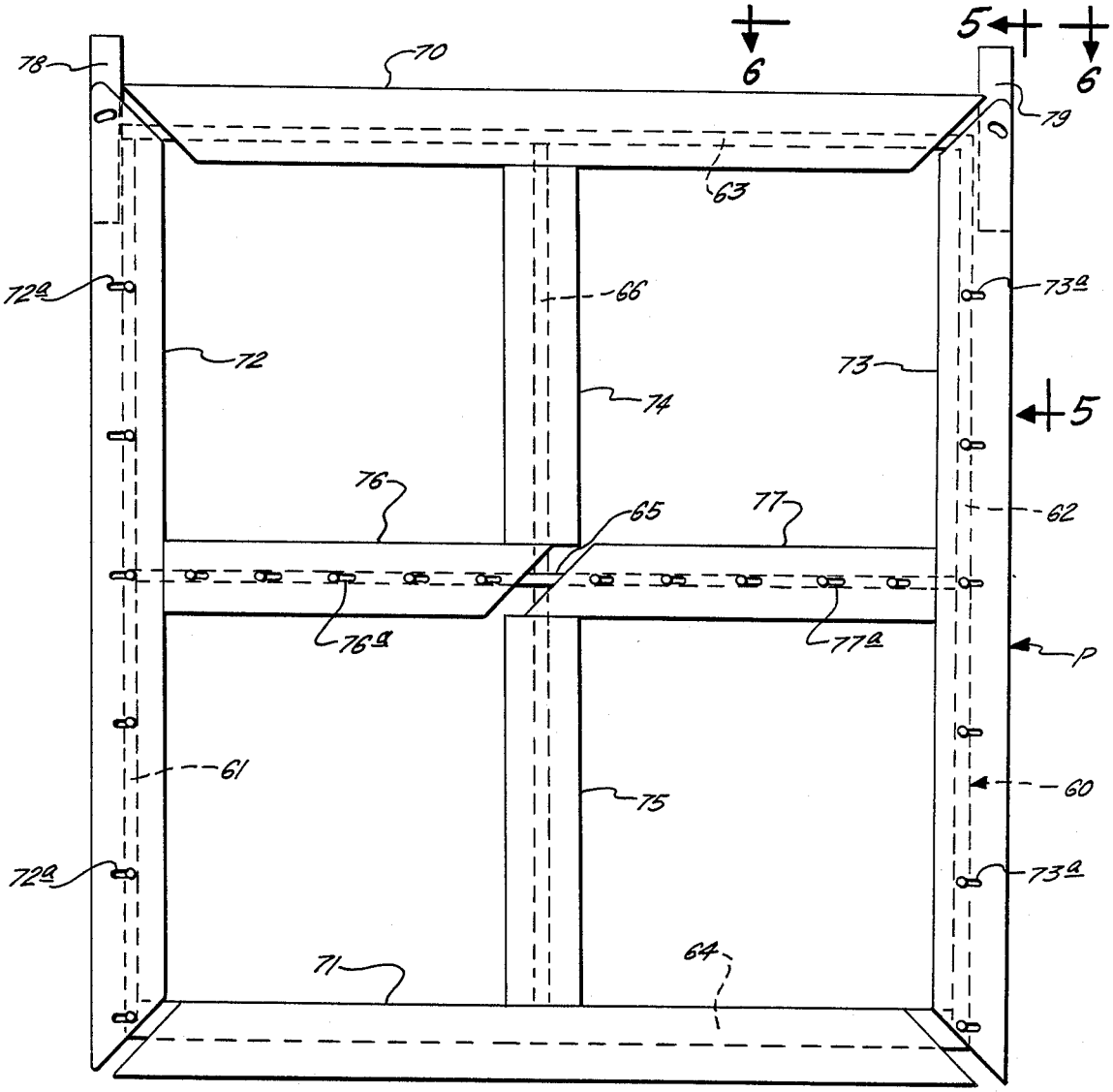
FIG. 4 is an enlarged top view of the top plane of the apparatus of FIG. 1.
Figure 5:
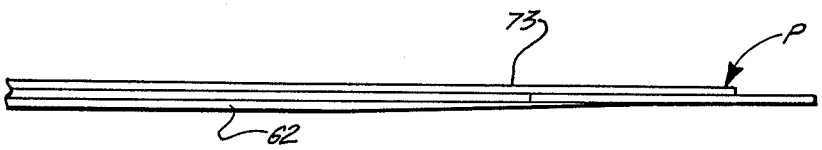
FIG. 5 is a sectional view of the top plane of FIG. 4 taken along line 5—5.
Figure 6:
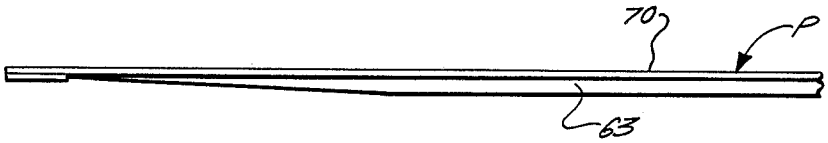
FIG. 6 is a sectional view of the top plane of FIG. 4 taken along line 6—6.

Referring now to FIG. 4, details of the top plane P are seen. Flat member 70 is attached to underlying frame support member 63 and flat member 74 is attached to underlying frame support member 66. The top edge of the member 74 fits substantially flush with the lower edge of the member 70. The lower edge of the member 74 also fits substantially flush with the upper edges of the members 76 and 77. Flat member 74 is mounted on support frame member 64 and flat member 75 is mounted on frame support member 66. The lower edge of the flat member 75 fits substantially flush with the top edge of the flat member 71. The top edge of the member 75 fits substantially flush with the lower edge of the member 76 and the lower edge of the member 77. The members 70, 71, 74 and 75 are attached to their respective support members by bolts and nuts or any other suitable means. The flat members 72, 73, 76 and 77 have a series of slots therein, **72*a*, 73*a*, 76*a* and 77*a*, respectively, through which bolts are inserted for attachment of the members to the underlying support frame 60. The T-shaped portion formed by the members 72 and 76 and the T-shaped portion formed by the members 73 and 77 may be laterally moved the distance provided by the slots and then secured in position. Lateral movement of the members 72 and 73** enables the top plane P to be adjusted a few inches for handling films of various widths. The top plane members are aligned in a specific fixed position in accordance with the width of film to be folded. It can also be appreciated that the top plane P can be constructed of one or more flat members as desired.

Referring to FIGS. 1–3 and 7 and 8, to assist the movement of the film over the trapezoidal former B, a series of rollers, **31*a*, 31*b* and 31*c*, are positioned on the rear frame member 31 and a series of rollers 32*a*, 32*b* and 32*c* are positioned on the rear frame member 32. Additionally, a series of rollers 38*a*, 38*b* and 38*c* are mounted on rear frame top member 38**. A greater or lesser number of rollers may be used as desired. In fact, no rollers at all are necessary, but the rollers do assist the movement of a sheet of film thereover. In lieu of rollers, the surfaces of the former B over which the film passes should be smooth or coated with a material such as Teflon.

Figures 9, 10:
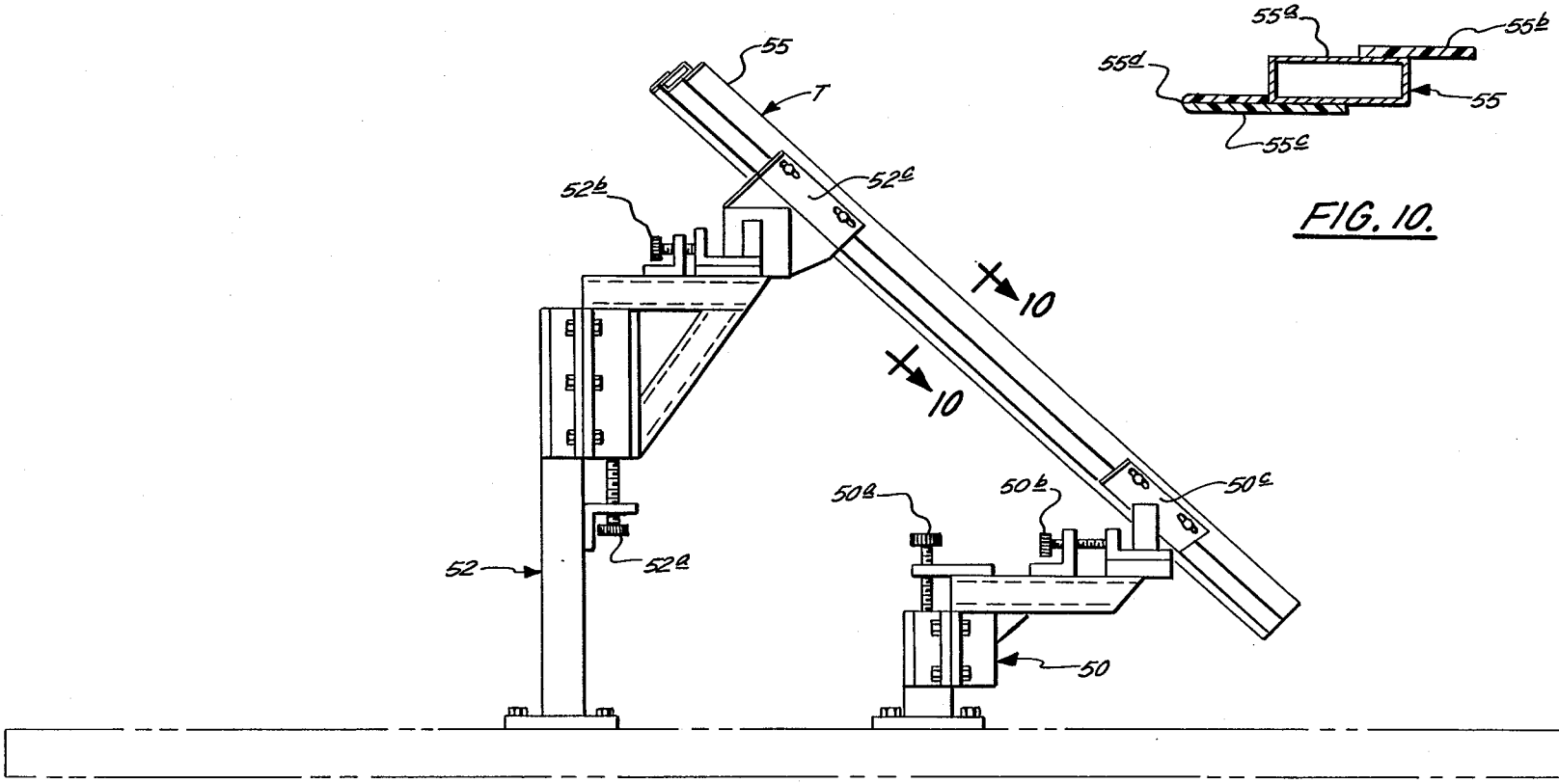
FIG. 9 is an enlarged view of the adjustment means for raising and lowering one side of the tucker bar of the invention; and, FIG. 10 is a sectional view taken along line 10—10 of FIG. 9.

The adjustment and support means 52 and 50 which support flat member 55 of the tucker bar or V-shaped member T is shown in somewhat more detail in FIG. 9.

The adjustment means 50 has a screw means 50*a* for raising or lowering the member 55 and an adjusting screw means 50*b* for providing somewhat lateral movement of the member 55. The adjustment mechanism 50 is attached to the bar 50 by slotted plate 50*c* which is attached to the tucker bar by bolts and nuts or any other suitable fashion. Upper adjusting means 52 has a elevating screw means 52*a* for raising and lowering the bar 55 and screw means 52*b* for lateral movement of the bar 55. The bar 55 is attached to the adjusting means 52 by means of a slotted plate 52*c* which is attached to the bar 55 by bolts and nuts or any other suitable means. Lower adjustment means 51 is similarly constructed as lower adjustment means 50 and is similarly attached to the member 54. Likewise, the upper tucker bar adjustment means 53 is substantially identical to the upper tucker bar adjusting means 52 and is attached to the tucker bar member 54. By adjusting the raising and lowering mechanism, and positioning the tucker bar on such adjusting means, the tucker bar can be raised or lowered to a desired position. Once in position, the tucker bar is secured in that position.

Although the particular construction of the tucker bar T can be varied as desired, a preferred type of bar 55 is shown in FIG. 10. The member 55 includes a box member 55*a* and a plastic member 55*b* attached to one side thereof and a plastic member 55*c* attached to the other side thereof. The plastic member 55*c* has a rounded corner 55*d* so as not to damage the film as it passes thereover.

In the operation of the apparatus A, one end of a sheet of film to be folded is guided to and received by the roller R and passed thereunder and then pulled across the rear frame up over the top plane with the edges of the film on each side thereof guided over the tucker bar T under the top plane P. The central portion of the film passes over the top plane P. A "U" shaped fold is made in the film and the film is then received by the idler roller R′ and transferred therefrom to a suitable take-up means. Once the film has been guided through the apparatus A and attached to the take-up means, the film folding operation is continuous. The film F is continually passed over the apparatus A until a desired amount of film is run. It can be appreciated that the apparatus A can be constructed so as to handle only a specific width of film. In which case, the various adjusting means can be eliminated and the various parts fixed in place. The adjustment means are preferred, however, since they provide an apparatus with more flexibility.

The foregoing disclosure and description of the invention is illustrative and explanatory thereof and various changes in the illustrated apparatus may be made within the scope of the appended claims without departing from the spirit of the invention.

What is claimed is:

1. An apparatus for continually folding large sheets of thermoplastic film comprising a trapezoidal former means for receiving a sheet of film to be folded thereover, which former means is relatively wide at one end and which tapers to a relatively narrow width about one-half the width of the relatively wide width and which extends downwardly across a flat plane of a width about the same as the narrower width, a V-shaped member or tucker bar mounted on the trapezoidal former means for receiving and inwardly folding the edges of the film to be folded, and a top plane mounted on the trapezoidal former means just above and substantially parallel to the tucker bar for receiving and guiding the central portion of the film which is unfolded thereover.

2. The apparatus of claim 1, comprising adjustment means for laterally adjusting the width of the top plane.

3. The apparatus of claim 1, wherein the top plane has an overall substantially rectangularly shaped surface.

4. The apparatus of claim 1, wherein the trapezoidal former means has a series of rollers located on said wide end of said trapezoidal former means for assisting the movement of the film over the apparatus.

5. The apparatus of claim 1, wherein the tucker bar comprises two longitudinal members joined together at one end to form a V-shaped member.

6. The apparatus of claim 1, comprising roller means adjacent the wide end of trapezoidal former means for receiving a sheet of film to be folded.

7. The apparatus of claim 1, comprising roller means adjacent the narrower end of the trapezoidal former means for receiving a sheet of film after it has been folded.

8. The apparatus of claim 1 comprising support means for supporting the trapezoidal former means and providing structural integrity to the apparatus.

9. The apparatus of claim 8, wherein said support means includes a plurality of vertical and horizontal members attached to the trapezoidal former means.

10. The apparatus of claim 9, wherein a plurality of cross members are attached to the vertical and horizontal support members and provide additional structural integrity to the apparatus.

11. An apparatus for continually folding large sheets of thermoplastic film and the like, comprising a trapezoidal former means for receiving a sheet of film to be folded thereover, which former means is relatively wide at one end and which tapers to a relatively narrow width about one-half the width of the relatively wide width and which extends downwardly across a flat plane of a width about the same as the narrower width, a V-shaped member or tucker bar mounted on the trapezoidal former means for receiving and inwardly folding the edges of the film to be folded, adjustment means for raising and lowering the tucker bar, and a top plane mounted on the trapezoidal former means just above and substantially parallel to the tucker bar for receiving and guiding the central portion of the film which is unfolded thereover.

* * * * *